US006170729B1

(12) United States Patent
Lin

(10) Patent No.: US 6,170,729 B1
(45) Date of Patent: Jan. 9, 2001

(54) NAILING DEPTH ADJUSTING DEVICE FOR A POWER NAILER

(75) Inventor: Rick Lin, Taichung (TW)

(73) Assignee: Basso Industry Corp., Taichung (TW)

( * ) Notice: Under 35 U.S.C. 154(b), the term of this patent shall be extended for 0 days.

(21) Appl. No.: 09/605,294

(22) Filed: Jun. 28, 2000

(51) Int. Cl.[7] ..... B25C 1/04
(52) U.S. Cl. ..... 227/8; 227/142
(58) Field of Search ..... 227/142, 8, 130

(56) References Cited

U.S. PATENT DOCUMENTS 5,219,110 * 6/1993 Mukoyama ..... 227/8
5,385,286 * 1/1995 Johnson, Jr. ..... 227/142
5,579,977 * 12/1996 Yang ..... 227/8
6,012,622 * 1/2000 Weinger et al. ..... 227/142
6,024,267 * 2/2000 Chen ..... 227/142

* cited by examiner

*Primary Examiner*—Scott A. Smith
(74) *Attorney, Agent, or Firm*—Charles E. Baxley

(57) ABSTRACT

A nailing depth adjusting device for a power nailer includes a link having a nose rod on a first end of the link and a connection plate extending laterally from a second end of the link. A threaded passage is defined in the connection plate for receiving a threaded section on a first end of a rotatable member. A flange extends radially outward from a distal end of the threaded section so that the threaded section will not disengaged from the threaded passage. A second end of the rotatable member is an engaging section which is rotatably mounted to a first end of a push member. A second end of the push member contacts a trigger mechanism of the nailer. The link is moved relative to the rotatable member by rotating the engaging section of the rotatable member.

4 Claims, 6 Drawing Sheets

NAILING DEPTH ADJUSTING DEVICE FOR A POWER NAILER

FIELD OF THE INVENTION

The present invention relates to a nailing depth adjusting device for a power nailer wherein a rotatable member threadedly extends through a link which is slidably received in a barrel of the nailer so that the link can be retractable relative to the barrel by rotating the rotatable member.

BACKGROUND OF THE INVENTION

A conventional nailing depth adjusting device for a power nailer is shown in FIG. 1 and generally includes a link 10 having a distal end extending from a front of the power nailer and a second end of the link 10 has a threaded section to which a nut 12 is mounted. The threaded section is rotatably supported by a first end of a push plate 11 and a second end of the push plate 11 contacts against a trigger means. The second end of the push plate 11 is used to release to a lock status of the trigger means so that when the push plate 11 is pushed toward the trigger means, the trigger can be pushed to eject a leading nail. A spring 13 is mounted to the threaded section of the link 10 and biased between the nut 12 and the first end of the push plate 11. A cap 14 is connected to the first end of the push plate 11 and encloses the threaded section of the link 10 from dust. A longer distance the link 10 is extended from the front end of the nailer, a shorter depth that the nailer penetrates into an object contacting the link 10. The movement of the link 10 is controlled by rotating the nut 12. However, the threaded section of the link 10 could be disengaged from the first end of the push plate 11 if the user rotates the nut 12 without noting the engagement between the threaded section and the nut 12.

The present invention intends to provide a nailing depth adjusting device for a power nailer wherein the link will never drop or be disengaged from the push member.

SUMMARY OF THE INVENTION

In accordance with one aspect of the present invention, there is provided a nailing depth adjusting device for a power nailer and comprising a link having a nose rod on a first end of the link and a connection plate extends laterally from a second end of the link. The connection plate has a threaded passage defined therein and a flange extends radially outward therefrom. A rotatable member has a threaded section on a first end thereof for extending through the threaded passage of the connection plate, and an engaging section on a second end of the rotatable member. A flange extends radially outward from a distal end of the threaded section. A push member has a first end rotatably inserted into the engaging section, and a second end of the push member contacts a trigger means of the nailer.

The primary object of the present invention is to provide a a nailing depth adjusting device for a power nailer wherein the rotatable member will never be disengaged from the link.

The object of the present invention is to provide These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
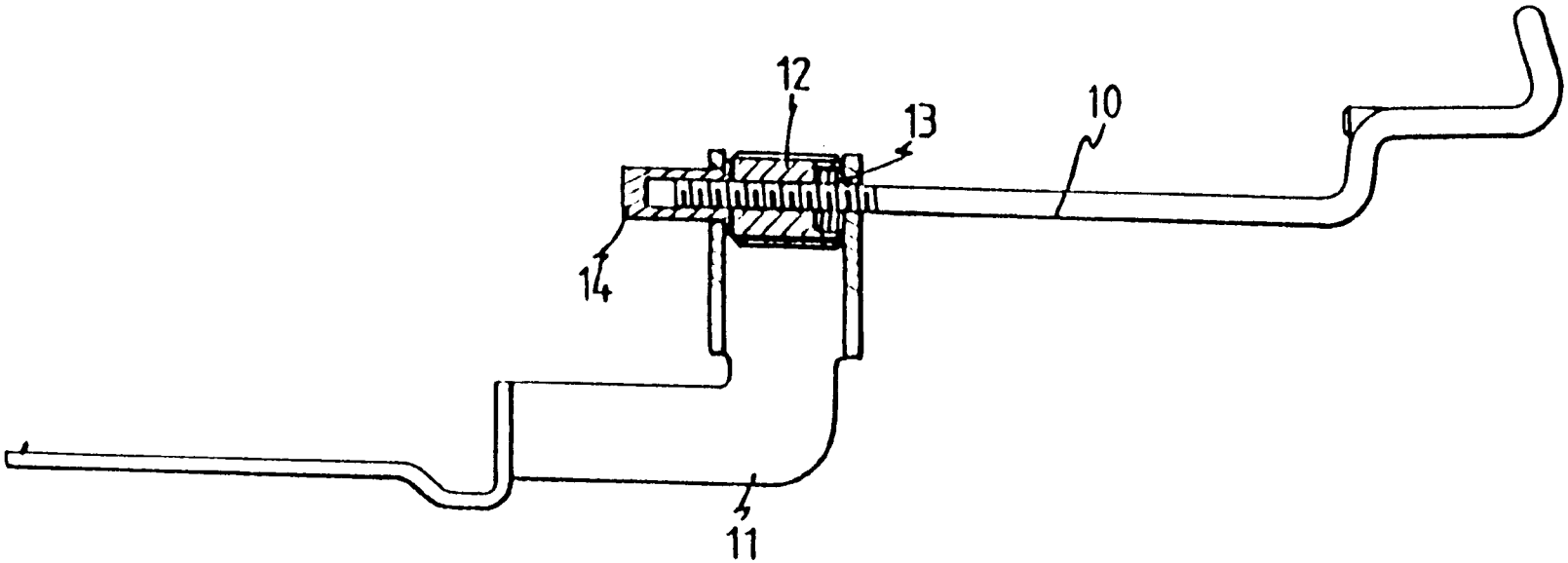
FIG. 1 PRIOR ART
FIG. 1 is a side elevational view, partly in section, of a conventional nailing depth adjusting device for a power nailer.
Figure 2:
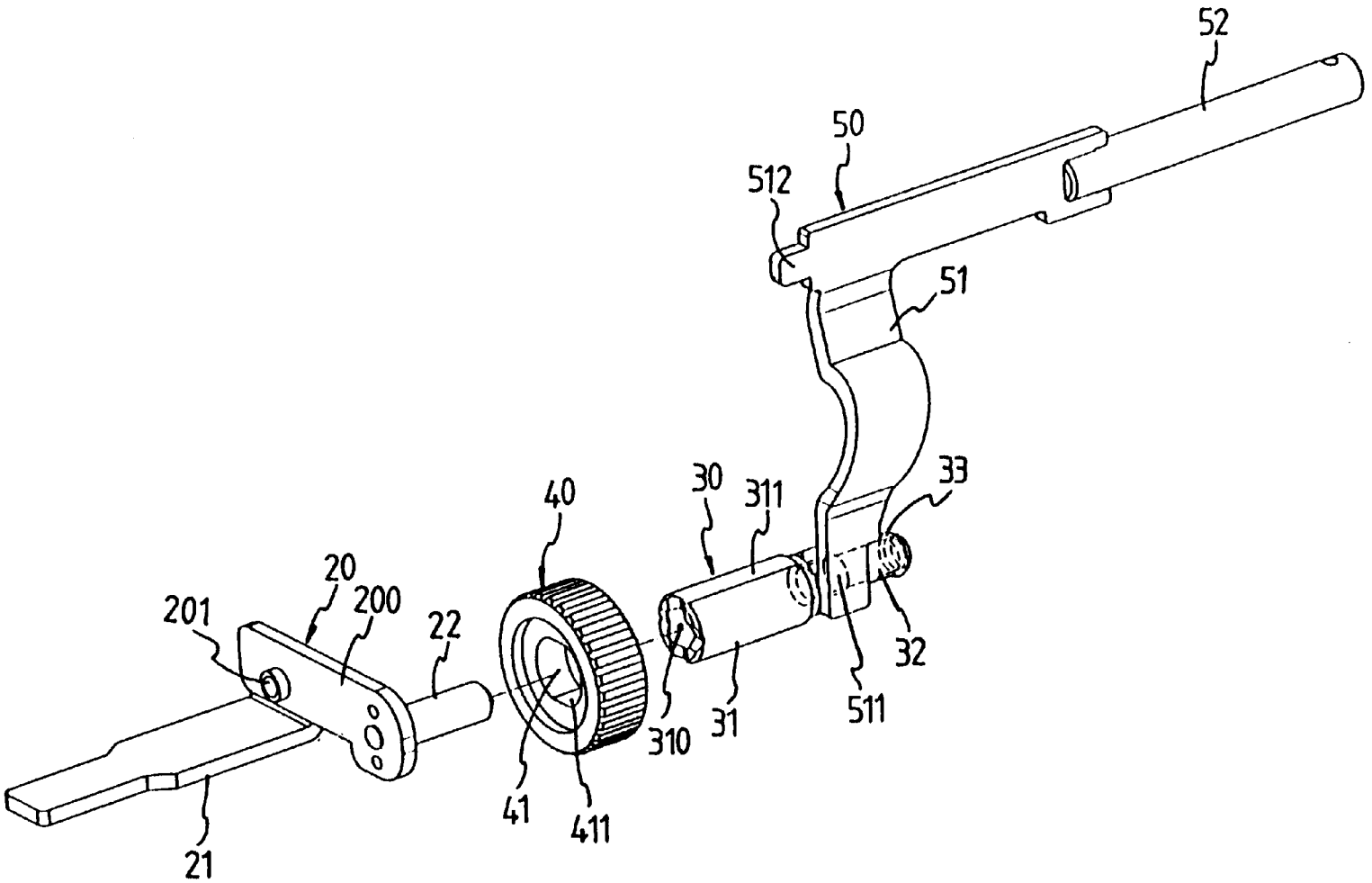
FIG. 2 is an exploded view to show a nailing depth adjusting device for a power nailer of the present invention.
Figure 3:
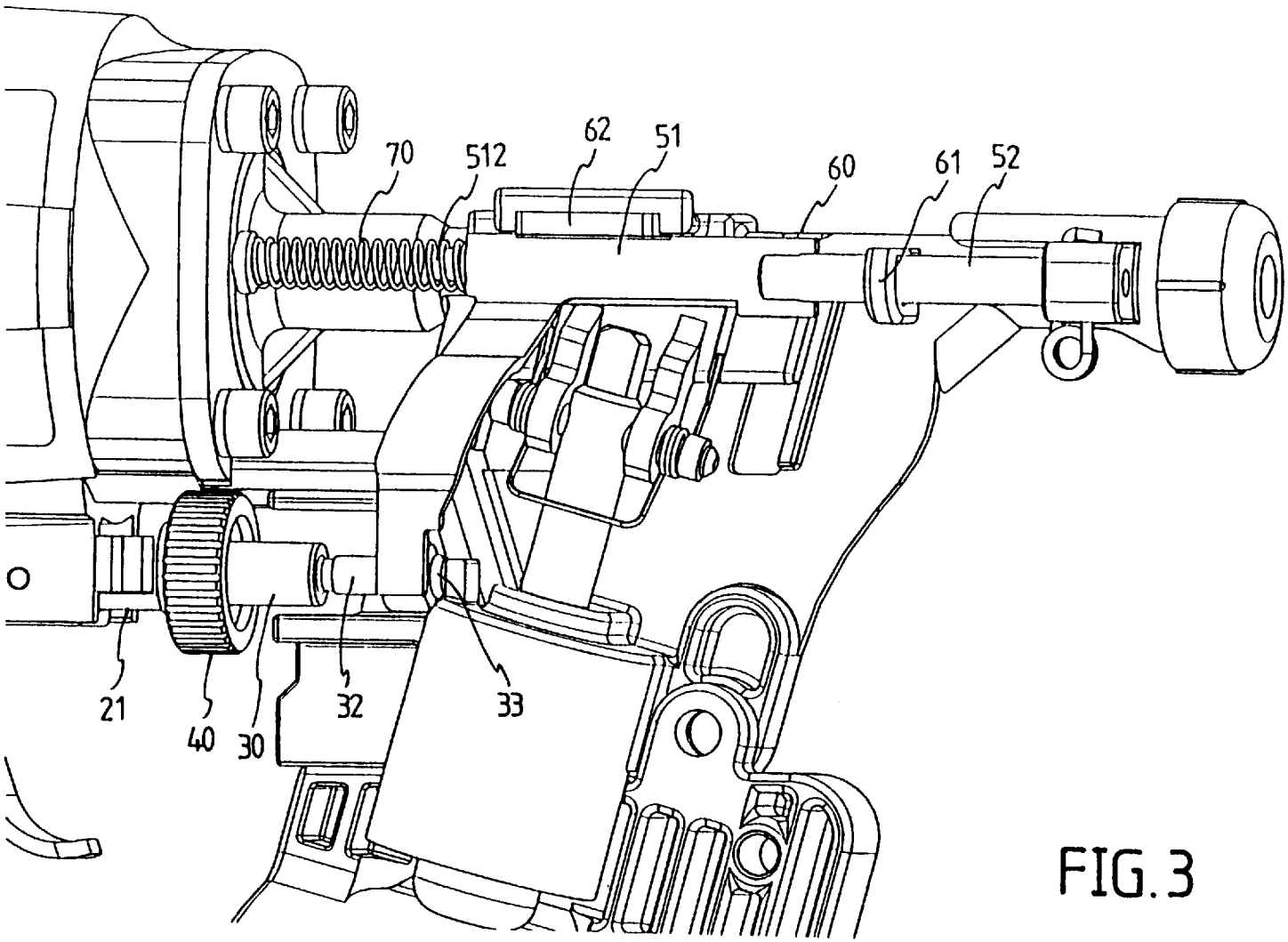
FIG. 3 is a perspective view to show the power nailer the with the nailing depth adjusting device of the present invention.
Figure 4:
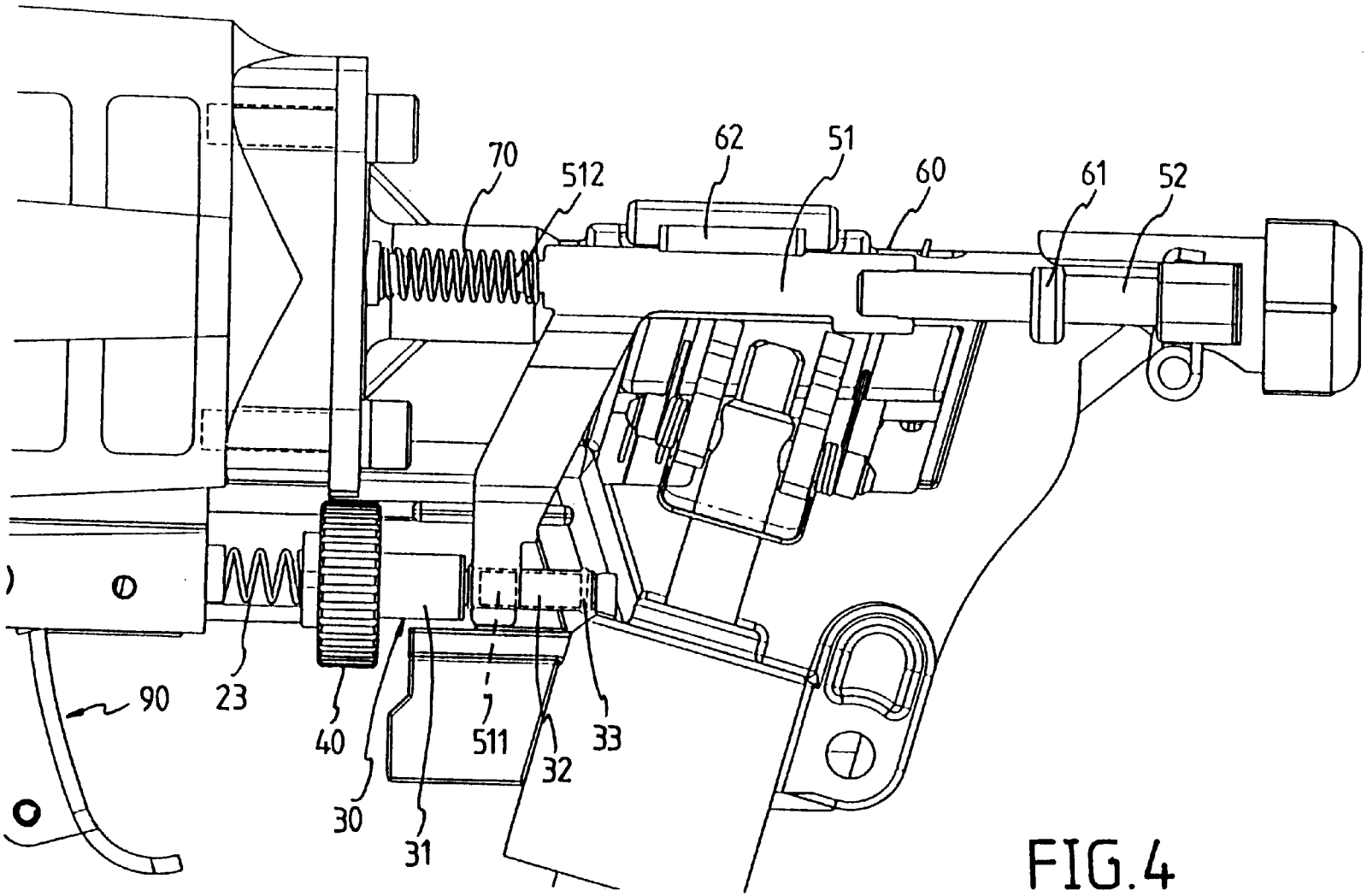
FIG. 4 is a side elevational view to show the power nailer with the nailing depth adjusting device of the present invention wherein a spring is biased between the trigger means and the push member.

Referring to FIGS. 2 to 4, the depth adjusting device for a power nailer of the present invention comprises a link 50 having a nose rod 52 on a first end of the link 50 and a connection plate 51 extending laterally from a second end of the link 50. The body of the link 50 is movably retained by a retaining plate 62 of a frame 60 of the nailer and the nose rod 52 of the link 50 extends through a ring 61 of the frame 60. The connection plate 51 has a threaded passage 511 defined in a distal end thereof. A rotatable member 30 has a threaded section 32 on a first end thereof and an engaging section 31 on a second end of the rotatable member 30. The threaded section 32 is threadedly engaged with the threaded passage 511 and a flange 33 extends radially outward from a distal end of the threaded section 32 so that the threaded section 32 will not disengaged from the threaded passage 511 of the connection plate 51 because a diameter of the flange 33 is larger than the threaded passage 511. The engaging section 31 is a tubular member and two first flat surfaces 311 are defined in an outer periphery of the tubular member. A recess 310 is defined longitudinally in the tubular member.

A protrusion 512 extends from the second end of the link 50 so that A first spring 70 has a first end mounted to the protrusion 512 and a second end of the first spring 70 contacts a body of the nailer. Therefore, when the link 50 is pushed toward the body of the nailer, the first spring 70 is compressed.

A push member 20 has a bar 200 and a rod 22 extends laterally from an end of a first side of the bar 200 and a plate 21 extends from a second side of the other end of the bar 200. A boss 201 extends from the second side of the bar 200 and is located beside the plate 21. As shown in FIG. 4, a second spring 23 has a first end mounted to the boss 201 and a second end of the second spring 23 contacts the trigger means 90. The rod 22 is rotatably inserted into the recess 310 in the engaging section 31 and the plate 21 of the push member 20 contacts a trigger means 90 of the nailer.

A collar member 40 has a central hole 41 defined therethrough and two second flat surfaces 411 defined in an inner periphery defining the central hole 41. The collar member 40 is mounted to the tubular member and the two first flat surfaces 311 mates with the second flat surfaces 411 so that when the collar member 40 is rotated, the engaging section 31 is rotated.

Figure 5:
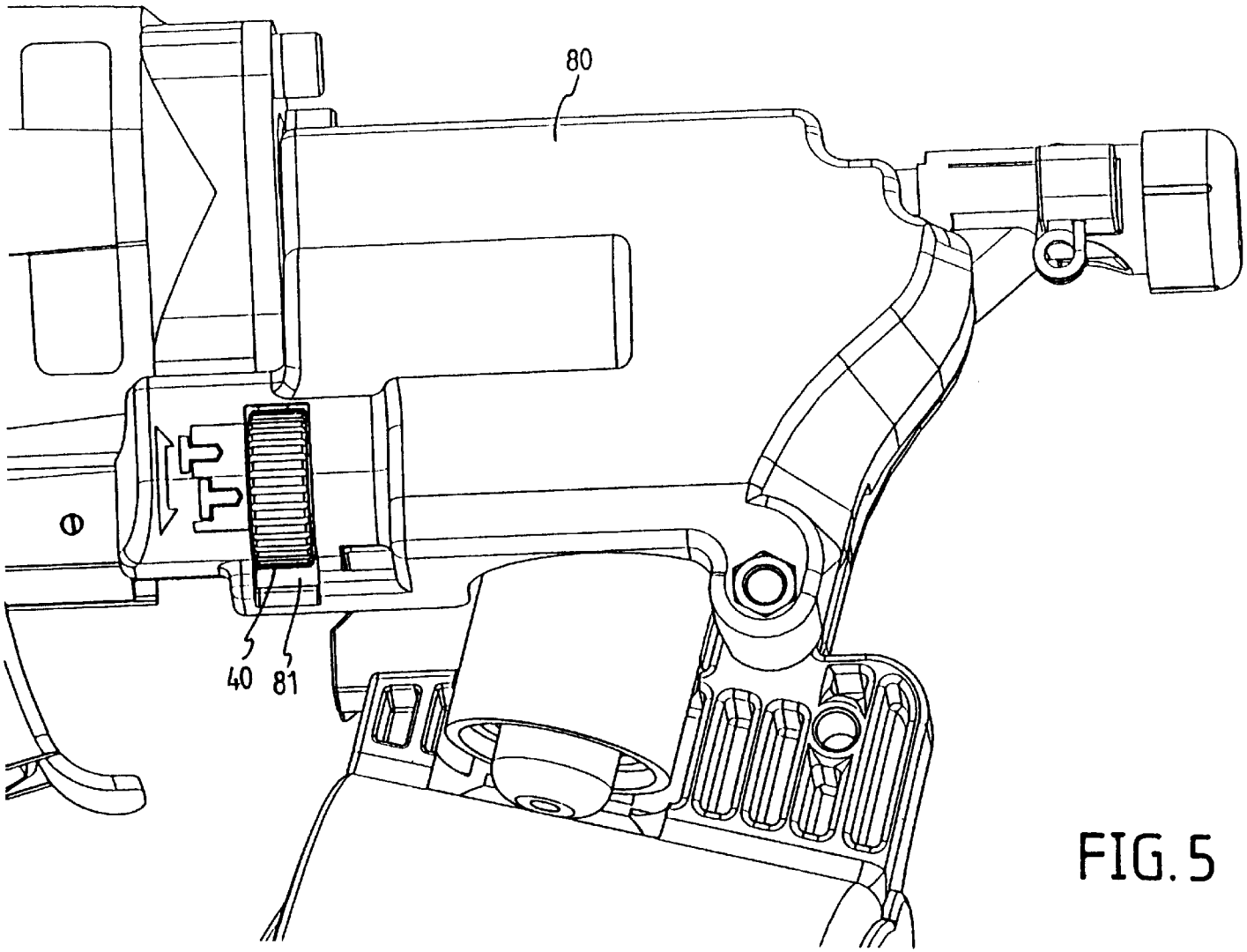
FIG. 5 is a perspective view to show the power nailer with a side cover mounted to the nailing depth adjusting device of the present invention.
Figure 6:
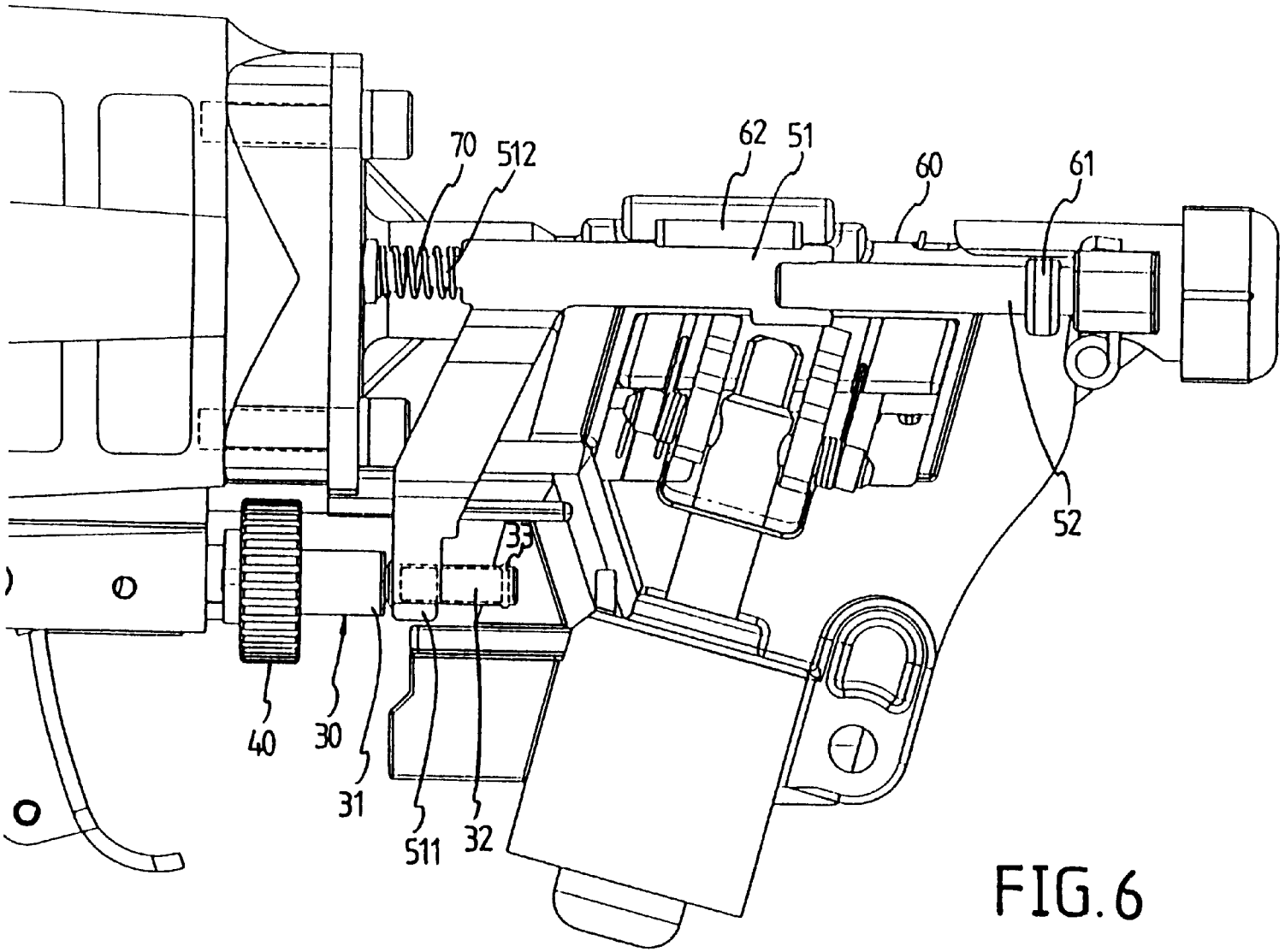
FIG. 6 is a side elevational view to show the power nailer with the link of the nailing depth adjusting device being pushed toward the body of the nailer.

As shown in FIG. 5, a side cover 80 is connected to a side of the nailer and covers the link 50 and the rotatable member 30. A notch 81 is defined in a lower side thereof so that the collar member 40 is accessed via the notch 81. As shown in FIG. 6, when rotating the collar member 40 to let the connection plate 51 be moved toward the body of the nailer alone the threaded section 32 of the rotatable member 30, the object (not shown) to be nailed is located close to the nailer so that the nailing depth will be the deepest. Otherwise, when rotating the collar member 40 in an opposite direction, the connection plate 51 be moved away from the body of the nailer alone the threaded section 32 of the rotatable member 30, the object (not shown) to be nailed is located far away from the nailer so that the nail only penetrates shallow.

The first spring 70 and the second spring 23 provide a stable and reliable movement of the link 50 so that each shoot will be powerful. The frame 60 guides the link 50 so that the link 50 is moved under well support.

While we have shown and described various embodiments in accordance with the present invention, it should be clear to those skilled in the art that further embodiments may be made without departing from the scope and spirit of the present invention.

What is claimed is:

1. A nailing depth adjusting device for a power nailer, comprising:

a link having a nose rod on a first end of said link and a connection plate extending laterally from a second end of said link, said connection plate having a threaded passage defined therein;

a rotatable member having a threaded section on a first end thereof and an engaging section connected to a second end of said rotatable member, said threaded section threadedly engaged with said threaded passage and a flange extending radially outward from a distal end of said threaded section, and a push member having a first end which is rotatably inserted into said engaging section, a second end of said push member adapted to contact a trigger means of the nailer.

2. The adjusting device as claimed in claim 1 wherein said engaging section is a tubular member and two first flat surfaces defined in an outer periphery of said tubular member, a recess defined longitudinally in said tubular member so that said first end of said push member is rotatably received in said recess, a collar member having a central hole defined therethrough and two second flat surfaces defined in an inner periphery defining said central hole, said collar member mounted to said tubular member and said two first flat surfaces mating with said second flat surfaces.

3. The adjusting device as claimed in claim 1 further comprising a protrusion on said second end of said link, a first spring having a first end mounted to said protrusion and a second end of said first spring adapted to contact a body of the nailer.

4. The adjusting device as claimed in claim 1 wherein said push member has a bar and a rod extends laterally from an end of a first side of said bar, a plate extending from a second side of the other end of said bar, a boss extending from said second side of said bar and located beside said plate, a second spring which has a first end mounted to said boss and a second end of said second spring adapted to contact the trigger means.

* * * * *